US005866289A

United States Patent [19]

Asanae et al.

[11] Patent Number: 5,866,289

[45] Date of Patent: Feb. 2, 1999

[54] DEVELOPER FOR ELECTROSTATIC DEVELOPMENT AND ELECTROSTATIC DEVELOPING METHOD USING SAME

[75] Inventors: Masumi Asanae, Kumagaya; Masahisa Ochiai, Fukaya, both of Japan

[73] Assignee: Hitachi Metals, Ltd., Tokyo, Japan

[21] Appl. No.: 892,587

[22] Filed: Jul. 14, 1997

[30] Foreign Application Priority Data

Jul. 15, 1996 [JP] Japan ..... 8-184399

[51] Int. Cl.[6] ..... G03G 9/107

[52] U.S. Cl. ..... 430/106.6; 430/122

[58] Field of Search ..... 430/106.6, 108, 430/122

[56] References Cited

U.S. PATENT DOCUMENTS 5,573,880 11/1996 Mayama et al. ..... 430/106.6
5,618,647 4/1997 Kukimoto et al. ..... 430/106.6
5,731,121 3/1998 Asanae ..... 430/106.6

FOREIGN PATENT DOCUMENTS 56-159653 12/1981 Japan .
57-155553 9/1982 Japan .

*Primary Examiner*—John Goodrow
*Attorney, Agent, or Firm*—Morgan, Lewis & Bockius LLP

[57] ABSTRACT

A developer for electrostatic development, which is a mechanical mixture of a magnetic toner containing a binder resin and a magnetic powder as the essential component and a magnetic carrier having a specific volume resistance of $10^9 \Omega \cdot$ cm or more. The properties of the magnetic toner and the magnetic carrier are correlated to each other so that an average particle size of the magnetic carrier is 0.5 to 6 times an average particle size of the magnetic toner, a magnetization of the magnetic carrier is 0.5 to 4 times a magnetization of the magnetic toner, and a triboelectric charge w of the magnetic carrier (Qc) and a triboelectric charge of the magnetic toner (Qt) satisfy an equation: $|Qt-Qc|=5$ to 50 $\mu$C/g.

15 Claims, 1 Drawing Sheet

DEVELOPER FOR ELECTROSTATIC DEVELOPMENT AND ELECTROSTATIC DEVELOPING METHOD USING SAME

BACKGROUND OF THE INVENTION

The present invention relates to a developer mixture of a magnetic toner and a magnetic carrier for use in electrophotographic process, electrostatic printing, electrostatic recording, etc. and an electrostatic developing method using the developer mixture. Specifically, the present invention relates to a developer mixture causing less carrier adhesion on a photosensitive surface and producing a high quality image, and an electrostatic developing method using such a developer mixture.

In a known electrophotographic imaging process and electrostatic recording process utilized in printers, facsimile machines, etc., an electrostatic latent image is formed on the surface of a cylindrical photosensitive drum. A developing roll composed of a sleeve and a permanent magnet mounted interiorly in the sleeve and rotatably relative to the sleeve is disposed opposite to the photosensitive drum. A magnetic developer is magnetically attracted on the surface of the sleeve and transported by the relative rotation of the sleeve to the magnet. The magnetic developer transported to a developing zone forms a magnetic brush which brushes the surface of the photosensitive drum to develop the electrostatic latent image to a visual toner image. The toner image is transferred onto a recording sheet which is then heated to permanently fix the toner image thereon.

Although a one-component developer only containing a toner comprising a binder resin and a magnetic powder may be used, a two-component developer which is a mixture of a magnetic carrier and a non-magnetic toner has been widely used in the magnetic brush developing method. Although the two-component magnetic developer produces images with a high density and high resolution, it is insufficient in halftone reproduction and requires a means for controlling the toner concentration in the developer. The one-component developer has problems of electric agglomeration of toner particles, developing defects due to insufficient electrification of toner particles on the sleeve.

To eliminate the above problems, a developer mixture of a magnetic carrier and a magnetic toner, which is expected to have advantageous properties of both the two-component developer and the one-component developer mentioned above, has been proposed.

To meet the recently increasing demand for producing high quality images, it has been proposed to use a magnetic toner with a reduced size, for example a magnetic toner having an average particle size of 5to 15 $\mu$m. The reduction of the toner size consequently requires a reduced size of the carrier. However, the carrier of reduced size is likely to produce images with white spots (developing defects) in the image area due to the carrier adhesion. The carrier adhesion may be prevented by increasing the magnetization intensity of the carrier. However, an excessively increased magnetization makes the magnetic brush rigid to result in reducing the developability.

Japanese Patent Laid-Open No. 56-159653 discloses a developer comprising a magnetic toner and an aggregated conductive magnetic particle having a volume average particle size smaller than that of the magnetic toner. Japanese Patent Laid-Open No. 57-155553 discloses a developer comprising a carrier having a particle size of 70 to 300 $\mu$m and a magnetic toner having a particle size of 5 to 50 $\mu$m.

However, the developers disclosed in the above documents still suffer from occurring the carrier adhesion to fail to produce images with no white spot in the image areas. Also, the aggregated conductive magnetic particle of Japanese Patent Laid-Open No. 56-159653 has a specific volume resistance of $10^9$ Ω•cm or less. Therefore, not only the toner but also the aggregated conductive magnetic particle, which are different from each other in color and fixing property, deposits on the latent image to fail to produce images of high quality.

OBJECT AND SUMMARY OF THE INVENTION

Accordingly, an object of the present invention is to provide a developer for use in an electrostatic developing process which causes less carrier adhesion and produces high quality images.

Another object of the present invention is to provide an electrostatic developing method suffering from less carrier adhesion and capable of producing high quality images.

As a result of the intense research in view of the above objects, the inventors have found that the developing deficiency such as carrier adhesion to a photosensitive surface, background toner deposition (background fogging), blurred image due to toner spreading, etc. can be effectively prevented by using a developer in which the toner and the carrier have the specific relationship with respect to the particle size, the magnetization intensity and the amount of triboelectric charge. The present invention has been accomplished based on this finding.

Thus, in a first aspect of the present invention, there is provided a developer for electrostatic development, which is a mechanical mixture of a magnetic toner containing a binder resin and a magnetic powder as the essential component and a magnetic carrier having a specific volume resistance of $10^9$ Ω•cm or more, an average particle size of the magnetic carrier being 0.5 to 6times an average particle size of the magnetic toner, a magnetization of the magnetic carrier being 0.5 to 4 times a magnetization of the magnetic toner, and a triboelectric charge of the magnetic carrier (Qc) and a triboelectric charge of the magnetic toner (Qt) satisfying an equation: $|Qt-Qc|=5$ to 50 $\mu$C/g.

In a second aspect of the present invention, there is provided an electrostatic developing method using the developer as defined above.

DETAILED DESCRIPTION OF THE INVENTION

Figure 1:
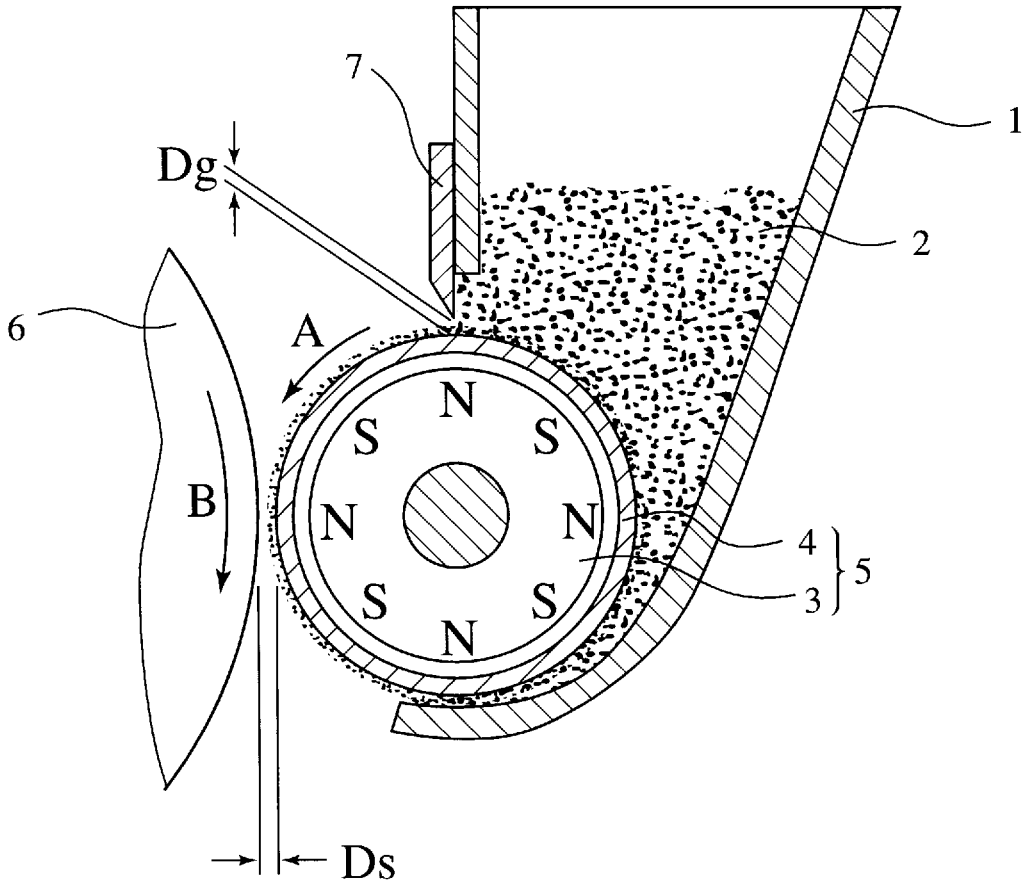
FIG. 1 is a schematic illustration showing a developing apparatus for practicing the present invention.

The magnetic toner used in the present invention contains a binder resin and a magnetic material as the essential component.

The volume average particle size of the toner (Dt) is 5 to 15 $\mu$m, preferably 5 to 12 $\mu$m in view of producing images with a high resolution.

Suitable resins for the binder resin may include homopolymers or copolymers of styrene compound such as p-chlorostyrene, methylstyrene, etc.; vinyl halides such as vinyl chloride, vinyl bromide, vinyl fluoride, etc.; vinyl esters such as vinyl acetate, vinyl propionate, vinyl benzoate, etc.; esters of α, β-unsaturated aliphatic monocarboxylic acid such as methyl acrylate, ethyl acrylate, butyl acrylate, isobutyl acrylate, dodecyl acrylate, n-octyl acrylate, 3-chloroethyl acrylate, phenyl acrylate, methyl α-chloroacrylate, butyl methacrylate, etc.; nitrites such as acrylonitrile, methacrylonitrile, etc.; amides such as acrylamide, etc.; vinyl ethers such as vinyl methyl ether, vinyl isobutyl ether, vinyl ethyl ether, etc.; vinyl ketones such as vinyl ethyl ketone, vinyl hexyl ketone, methyl isopropenyl ketone, etc. Other resins such as epoxy resins, crosslinked silicone resins, rosin-modified phenol-formaldehyde resins, cellulose resins, polyether resins, polyvinyl butyral resins, polyester resins, styrene-butadiene resins, polyurethane resins, polycarbonate resins, fluorocarbon resins such as tetrafluoroethylene, etc. may be also usable. These resin materials may be used alone or in combination. Among them, styrene-acrylic resins, silicone resins, epoxy resins, styrene-butadiene resins, cellulose resins, etc. are particularly preferable.

The magnetic toner contains 20 to 60% by weight of a fine powder, preferably 0.1 to 3 $\mu$m in terms of a number average particle size, of the magnetic material such as magnetite, soft ferrites, etc. so that the magnetic toner has a magnetization ($\sigma_{1000t}$) of 11 to 40emu/g when measured in a magnetic field of 1000 Oe. The intensity of $\sigma_{1000t}$ may be regulated within the above range by suitably selecting the kind, the addition amount and the coercive force (iHc) of the magnetic material in a manner known in the art. When the addition amount is less than 20% by weight, the toner has a small $\sigma_{1000t}$ and is easily scattered. An amount larger than 60% by weight excessively increases $\sigma_{1000t}$ to deteriorate the developability and fixing property.

The magnetic toner is preferred to be an insulating toner having a specific volume resistance (Rt) of $10^{14}$ $\mu$•cm or more in view of improving the transferring property, and to be easily electrified by the friction with the carrier and/or a doctor blade. The amount of triboelectric charge (Qt) to be acquired by the toner is 10 $\mu$C/g or more, preferably 10 to 100 $\mu$C/g in terms of absolute value. The polarity and the amount of the triboelectric charge may be controlled by a known method. Generally, the polarity is determined by selecting a type of a charge controlling agent. For example, the toner acquires positive charges when nigrosine is contained, and negative charges when a metal-containing azo dye is contained. Although Qt is influenced by the kind and the amount of the binder resin, it may be regulated within the above range by suitably selecting the addition amount of the charge controlling agent, preferably up to 5% by weight based on the toner. The charge controlling agent usable in the present invention is not specifically limited, and may include those known in the art.

The toner may optionally contain other additives. A releasing agent such as polyolefin may be contained in an amount up to 10% by weight, and a colorant such as carbon black may be contained in a small amount. When the toner contains magnetite as the magnetic material, the colorant may be omitted. A flowability improver may be internally or externally added to the toner. The flowability improver to be internally added may be zinc stearate, polyvinylidene fluoride, silicone varnish, etc., and the addition amount thereof is 0.1 to 5% by weight. The flowability improver to be externally added may be zinc stearate, polyvinylidene fluoride, hydrophobic silica, etc., and the addition amount thereof is 0.1 to 2% by weight. The addition of the flowability improver exceeding the above range unfavorably causes background fogging.

The toner may be produced by a known method. For example, the binder resin, the magnetic material and optional additives such as the charge controlling agent, colorant, releasing agent, flowability improver, etc. are mechanically mixed in a mixing machine such as a ball mill, etc. to give a uniform mixture. In a kneading machine such as heating roll, kneader, etc., the binder resin in the mixture is molten by heating and the magnetic powder and the additive are well dispersed or dissolved in the molten resin so that a homogeneous dispersion or solution is achieved. After cooling, the solidified product is pulverized coarsely and then finely to produce the toner with desired particle size and properties.

The magnetic carrier may be a powder of a magnetic metal such as iron or a powder of a magnetic oxide such as ferrite, magnetite, etc. The ferrite may be Ni-Zn ferrite, Cu-Zn ferrite, Ba-Ni-Zn ferrite, etc. The surface of the magnetic carrier may be completely or partly coated with a resin in an amount of 0.3 to 3parts by weight per 100parts by weight of the magnetic carrier. The resin for coating the magnetic carrier may be selected from those exemplified as the binder resin for the magnetic toner.

The magnetic carrier may be a resin-bonded carrier in which 20 to 90% by weight, based on the amount of the magnetic carrier, of the powder of the magnetic metal and/or magnetic oxide mentioned above is dispersed in a resin, preferably a thermoplastic resin. The resins for the binder resin of the magnetic toner may be also used as the resin for the resin-bonded carrier. The use of the thermoplastic resin is advantageous because the resin-bonded carrier accidentally adhered to the photosensitive surface is transferred to and fixed on a recording sheet together with the magnetic toner, thereby causing no image deficiency due to carrier adhesion to the photosensitive surface. To enhance this advantage, the resin-bonded carrier may contain a colorant.

The specific volume resistance of the magnetic carrier (Rc) is $10^9$Ω•cm or more, preferably $10^9$ to $10^{14}$Ω•cm. When less than $10^9$ Ω•cm, the magnetic carrier readily adheres to the photosensitive surface thereby causing the leak of the photosensitive surface charge placed by a charging means and producing images of a poor quality. Also, a specific volume resistance less than $10^9$ Ω•cm of the magnetic carrier fails to charge the toner regularly and uniformly.

The weight average particle size of the magnetic carrier (Dc) is 0.5 to 6times, preferably 1.0 to 3.5times the volume average particle size of the magnetic toner (Dt). When less than 0.5 times, the magnetic carrier readily adheres to the photosensitive surface, and when larger than 6 times, the magnetic carrier fails to charge the magnetic carrier in a sufficient level because the specific surface area of the magnetic carrier is reduced.

The magnetization of the magnetic carrier ($\sigma_{1000c}$) when measured in a magnetic field of 1000 Oe is 0.5 to 4 times, preferably 0.8 to 3 times the $\sigma_{1000t}$. When less than 0.5 times, the carrier adhesion to the photosensitive surface readily occurs. When larger than 4 times, a large torque is required to transport the developer. Also, an increased amount of spent carrier reduces the life time of the magnetic carrier and causes the background fogging. The intensity of $\sigma_{1000c}$ may be easily regulated within the above range by suitably selecting the chemical composition for the ferrite carrier. In the resin-bonded magnetic carrier, $\sigma_{1000c}$ may be regulated within the above range by suitably selecting the kind and/or the content of the magnetic powder. The intensity of $\sigma_{1000c}$ may be also regulated by changing the coercive force (iHc) of the magnetic powder. The $\sigma_{1000c}$ of the powder of the magnetic metal such as iron and the magnetite powder remains nearly constant. In this case, the magnetization of the magnetic toner ($\sigma_{1000t}$) is regulated so that the $\sigma_{1000c}$ of the iron carrier or magnetite carrier is within the range of 0.5 to 4 times the $\sigma_{1000t}$.

The amount of triboelectric charge (Qc) of the magnetic carrier is regulated so as to satisfy the equation: $|Qt-Qc|=5$ to 50 $\mu$C/g. In a normal development with a negative photosensitive surface or a reversal development with a positive photosensitive surface, Qt−Qc is +5 to +50 $\mu$C/g. In a normal development with a positive photosensitive surface or a reversal development with a negative photosensitive surface, Qt−Qc is −5 to −50 $\mu$C/g. If the difference Qt−Qc is outside the above range, blurring images of a poor quality are produced due to the background fogging, spreading of toner, etc. The Qc may be regulated by suitably selecting the magnetic material from the magnetic metals and magnetic oxides, by suitably selecting the kind of the coating resin and the coating amount. The Qc of the resin-bonded carrier may be regulated by suitably selecting the kind and the content of the resin. Further, the Qc of the resin-coated carrier or the resin-bonded carrier may be regulated by incorporating into the resin a charge controlling agent which may be contained up to about 5% by weight of the carrier.

The magnetic carrier coated with a resin may be produced as follows. First, the resin material is dissolved in an adequate solvent such as benzene, toluene, xylene, methyl ethyl ketone, tetrahydrofuran, chloroform, hexane, etc., to produce a resin solution or emulsion. The solution or emulsion is sprayed onto the magnetic powder to coat it with the resin completely or partly. To obtain the uniform resin coating, the magnetic powder is preferably maintained in a fluidized state desirably by employing a spray dryer or a fluidized bed. The spraying is carried out at about 200° C. or lower, preferably at about 100°–150° C., to simultaneously carry out the rapid removing of the solvent from the resultant resin coating and the drying of the coating.

The resin-bonded carrier may be produced in a manner basically the same as in the production of the magnetic toner.

The magnetic toner and the magnetic carrier are mechanically mixed in the developing apparatus to produce a developer. The magnetic toner and the magnetic carrier should be selected so that the average particle sizes, the magnetizations and the amounts of triboelectric charge thereof satisfy the relationship defined above. The toner concentration in the developer is 5 to 70% by weight.

The developer of the present invention may be preferably used in a magnetic brush development using a developing apparatus as shown in FIG. 1. The magnetic toner 2 is stored in a toner container 1. A developing roll 5 comprising a permanent magnet roll 3 having a plurality of magnetic poles on the surface portion thereof, each magnetic pole extending in the axial direction, and a hollow cylindrical non-magnetic sleeve 4 made of stainless steel, etc. is received in the bottom of the toner container 1. The magnet roll 3 is concentrically mounted in the sleeve 4, and both the magnet roll 3 and the sleeve 4 are rotatable relatively to each other. The sleeve 4 is not essential in the present invention, and a sleeve-less magnet roll may be used. An image-bearing member 6 having a photosensitive surface is rotatably disposed opposite to the developing roll 5 defining a developing gap Ds (0.3 to 0.6mm) therebetween.

By the rotation of the sleeve 4 in the direction indicated by an arrow A relative to the rotation of the magnet roll 3 or the rotation of the magnet roll 3 in a sleeve-less system, the magnetic toner 2 in the toner container 1 is mixed with a magnetic carrier magnetically attracted on the sleeve 4 (or the magnet roll 3 in the sleeve-less system) in advance. The magnetic toner 2 and the magnetic carrier is further mixed when passing through a doctor blade 7 having a doctor gap Dg (0.2 to 0.5 mm) to form a developer layer on the sleeve 4 or the magnet roll 3. The developer on the sleeve 4 or the magnet roll 3 forms a magnetic brush by the magnetic field from the magnetic poles. When the magnetic brush brushes the surface of the image-bearing member 6 rotating in the direction indicated by an arrow B, the magnetic toner 2 is attracted from the magnetic carrier in the magnetic brush to the charged areas of the image-bearing surface, thus developing the latent image. The outer diameter of the sleeve 4 is usually 10 to 32 mm and the sleeve is rotated at 100 to 400 r.p.m.

In the present invention, the properties of the magnetic toner and the magnetic carrier were determined in the following manner.

The magnetizations of the magnetic carrier and the magnetic toner ($\sigma_{1000t}$ and $\sigma_{1000c}$) were measured by using a vibrating magnetometer (VSM-3 manufactured by Toei Kogyo K. K.).

The volume average particle size of the magnetic toner (Dt) was measured by a particle size analyzer (Coulter Counter Model TA-II manufactured by Coulter Electronics Co.).

The weight-average particle size of the magnetic carrier (Dc) was calculated from a particle size distribution obtained by a multi-sieve shaking machine.

The specific volume resistance of the magnetic toner and magnetic carrier was determined as follows. An appropriate amount (about 10 mg) of the toner or carrier was charged into a Teflon (trade name) cylinder having an inner diameter of 3.05 mm. The sample was exposed to an electric field of D.C. 10 kV/cm under a load of 0.1 kgf to measure an electric resistance using an insulation-resistance tester (4329-type manufactured by Yokogawa-Hewlett-Packard, Ltd.).

The triboelectric charges of the magnetic carrier and the magnetic toner were determined as follows. Into a polyethylene vessel having a volume of 100 $cm^3$, were added 95 g of a Cu-Zn ferrite carrier (KBN-220 manufactured by Hitachi Metals, Ltd., particle size: 74 to 149 $\mu$m (#100/#200)) and 5g of a magnetic carrier or a magnetic toner to be tested. Then the mixture was mechanically mixed for 30 minutes at 22° C. under a relative humidity of 50%. The triboelectric charge was measured by using a blow-off powder electric charge measuring apparatus (TB-200 manufactured by Toshiba Chemical Co. Ltd.). The blow-off was carried out for 30 seconds at 22° C. and a relative humidity of 50% under a blowing pressure of 1.0 $kgf/cm^2$. The sieving was conducted using a mesh of #325 (44 $\mu$m) to allow only the toner to pass through but preventing the carrier. When the magnetic carrier being tested and the Cu-Zn ferrite carrier (KBN-220) had particle size distributions overlapping each other, and were not sieved out thoroughly, these carriers were separated by a magnet blow utilizing the difference of magnetic force.

The present invention will be further described while referring to the following Examples which should be considered to illustrate various preferred embodiments of the present invention.

Preparation of Toner

Starting materials consisting of:

styrene-acrylic resin (binder resin; Priotone ACL manufactured by GoodYear Co. or UNI3500 manufactured by Sanyo Chemical Industries, Ltd.), magnetic powder (EPT-500 (magnetite) manufactured by Toda Kogyo K. K. or KBC-100 (magnetite) manufactured by Kanto Denka K. K.), polypropylene (release agent; TP32 manufactured by Sanyo Chemical Industries, Ltd.), and charge-controlling agent (Bontron N-04 manufactured by Orient Chemical Industries or Kayacharge T-2N manufactured by Nippon Kayaku K. K.) in the respective weight ratios shown in Table 1 were dry-mixed, kneaded under heating at 150 to 190° C. and solidified by cooling. The solidified product was coarsely pulverized in a pin mill, finely pulverized in a jet mill and classified to obtain toner particles having each average particle size. The toner particles were externally added with a silica (Aerosil R972 manufactured by Nippon Aerosil K. K. or H2050EP manufactured by Wacker Chemical K. K.) in an amount listed in Table 1.

TABLE 1

| Test No. | Binder resin (wt. %) | | Magnetic powder (wt. %) | | Polypropylene (wt. %) | | Charge controlling agent (wt. %) | | Silica (wt. %) | |
|---|---|---|---|---|---|---|---|---|---|---|
| 1 | ACL* | 56 | EPT* | 40 | TP32 | 2 | N-04 | 2 | H2050EP | 0.5 |
| 2 | ACL | 56 | EPT | 40 | TP32 | 2 | N-04 | 2 | H2050EP | 0.5 |
| 3 | ACL | 56 | EPT | 40 | TP32 | 2 | N-04 | 2 | R972 | 0.5 |
| 4 | ACL | 41 | EPT | 55 | TP32 | 2 | N-04 | 2 | H2050EP | 0.5 |
| 5 | ACL | 56 | EPT | 40 | TP32 | 2 | N-04 | 2 | H2050EP | 0.5 |
| 6 | ACL | 56 | EPT | 40 | TP32 | 2 | N-04 | 2 | R972 | 0.5 |
| 7 | ACL | 56 | EPT | 40 | TP32 | 2 | N-04 | 2 | R972 | 0.5 |
| 8–11 | ACL | 56 | EPT | 40 | TP32 | 2 | N-04 | 2 | H2050EP | 0.5 |
| 12–15 | ACL | 56 | EPT | 40 | TP32 | 2 | N-04 | 2 | H2050EP | 0.5 |
| 16–19 | UNI* | 57 | KBC* | 40 | TP32 | 2 | T-2N | 2 | R972 | 0.8 |

ACL: Priotone ACL
UNI: UNI3500
EPT: EPT-500
KBC: KBC-100

Preparation of Carrier

A resin-bonded magnetic carrier was prepared as follows. Starting materials consisting of:

resin (Priotone AC manufactured by GoodYear Co., H1007 manufactured by Yuka Shell, Ltd. or KTR2150 manufactured by Kao Corporation), magnetic powder (MAT-222 (magnetite) or EPT-500 (magnetite) manufactured by Toda Kogyo K. K.), and charge-controlling agent (FCA201 manufactured by Fujikura Kasei K. K., Kayacharge T-2N manufactured by Nippon Kayaku K. K., or N-04 or S-34 both manufactured by Orient Chemical Industries) in the respective weight ratios shown in Table 2 were subjected to the same procedures as in the production of the toner to obtain the resin-bonded carriers. The magnetic powder of the carrier No. 8 was treated with an aminosilane coupling agent (SH6020 manufactured by Toray Silicone, Ltd.). The carriers of Nos. 10, 16 and 17 were coated with a fluorine resin to regulate the specific volume resistance.

TABLE 2

| Test No. | Resin (wt. %) | | Magnetic powder (wt. %) | | Charge controlling agent (wt %) | | Remarks |
|---|---|---|---|---|---|---|---|
| 1 | AC | 58 | MAT-222 | 40 | FCA201 | 2 | |
| 2 | AC | 38 | MAT-222 | 60 | FCA201 | 2 | |
| 3 | AC | 39 | MAT-222 | 60 | T-2N | 2 | |
| 4 | AC | 58 | MAT-222 | 40 | FCA201 | 2 | |
| 5 | AC | 40 | MAT-222 | 60 | — | | |
| 6 | H1007 | 38 | MAT-222 | 60 | FCA201 | 2 | |
| 7 | KTR2150 | 34 | MAT-222 | 65 | S-34 | 1 | |
| 8 | H1007 | 58 | MAT-222 | 40 | FCA201 | 2 | SH6020 treatment |
| 9 | AC | 59 | MAT-222 | 40 | T-2N | 1 | |
| 10 | — | | Cu—Zn ferrite | | — | | Fluorine resin coating (0.7%) |
| 11 | — | | Iron powder | | — | | |
| 12 | AC | 50 | MAT-222 | 50 | — | | |
| 13 | AC | 39.5 | MAT-222 | 60 | T-2N | 0.5 | |
| 14 | AC | 37 | MAT-222 | 60 | FCA201 | 3 | |
| 15 | AC | 39.5 | MAT-222 | 60 | N-04 | 0.5 | |
| 16 | — | | Iron powder | | — | | Fluorine resin coating (1.5%) |
| 17 | — | | Cu—Zn ferrite | | — | | Fluorine resin coating (1.0%) |
| 18 | AC | 38 | EPT-500 | 60 | FCA201 | 2 | |
| 19 | AC | 49.5 | EPT-500 | 50 | S-34 | 0.5 | |

EXAMPLE 1

By using the magnetic toners Nos. 1 to 11 and the corresponding magnetic carriers Nos. 1 to 11, the developing test was conducted in the developing apparatus shown in FIG. 1.

The developing conditions were as follows:

Normal development

Photosensitive surface: negatively chargeable OPC

−600 V of surface voltage

70mm/sec of peripheral speed (clockwise)

Sleeve: stainless (SUS304)

20 mm of outer diameter 140 r.p.m. (counterclockwise)

Permanent magnet: symmetrical 8 poles

750 G of surface magnetic flux density 500 r.p.m. (counterclockwise)

Developing gap (Ds): 0.5 mm

Doctor gap (Dg): 0.2 mm

Bias to sleeve: DC of Vb=−120 V superposed with AC of

Vp-p=2000 V (peak to peak voltage) and f=1.0 kHz

Transfer: corona transfer to ordinary paper

Fixing: heat roll fixing at 180° C. under line pressure of 1 kgf/cm

The results are shown in Table 3. The image density is a reflectance optical density measured by a Macbeth densitometer. The background fogging is a difference in density of non-printed area of paper between before and after printing, and was measured by a colorimetric color-difference meter manufactured by Nippon Denshoku Kogyo K. K.

TABLE 3

| | Magnetic Toner | | | Magnetic Carrier | | | | Toner |
|---|---|---|---|---|---|---|---|---|
| Test No. | $\sigma_{1000t}$ (emu/g) | Dt (μm) | Qt (μC/g) | Rc (Ω · cm) | $\sigma_{1000c}$ (emu/g) | Dc (μm) | Qc (μC/g) | Concentration (wt. %) |
| Invention | | | | | | | | |
| 1 | 22 | 9.0 | 27.3 | $10^{14}$ | 23 | 12 | 5.3 | 10 |
| 2 | 22 | 10.1 | 25.5 | $10^{14}$ | 33 | 16 | 3.5 | 30 |
| 3 | 20 | 7.5 | 20.7 | $10^{14}$ | 33 | 20 | −18.1 | 50 |
| 4 | 27 | 12.0 | 15.3 | $10^{14}$ | 22 | 25 | 5.7 | 20 |
| 5 | 22 | 9.0 | 27.3 | $10^{14}$ | 33 | 16 | 0.9 | 40 |
| 6 | 20 | 7.5 | 20.7 | $10^{14}$ | 23 | 12 | 15.1 | 60 |
| 7 | 20 | 7.0 | 25.0 | $10^{12}$ | 35 | 35 | −23.0 | 10 |
| Comparison | | | | | | | | |
| 8 | 22 | 9.0 | 27.3 | $10^{12}$ | 23 | 12 | 22.8 | 50 |
| 9 | 22 | 9.0 | 27.3 | $10^{12}$ | 23 | 12 | −23.5 | 50 |
| 10 | 22 | 9.0 | 27.3 | $10^{12}$ | 52 | 55 | −3.5 | 50 |
| 11 | 22 | 10.1 | 25.5 | $10^{8}$ | 63 | 30 | 4.3 | 20 |

| | | | | Image Quality | | | | |
|---|---|---|---|---|---|---|---|---|
| Test No. | $\sigma_{1000c}/\sigma_{1000t}$ | Dc/Dt | Qt-Qc (μC/g) | image density | background fogging | toner spreading | resolution | carrier adhesion |
| Invention | | | | | | | | |
| 1 | 1.05 | 1.33 | 22.0 | 1.35 | 0.08 | none | good | none |
| 2 | 1.50 | 1.58 | 22.0 | 1.37 | 0.08 | none | good | none |
| 3 | 1.65 | 2.67 | 38.8 | 1.31 | 0.07 | none | good | none |
| 4 | 0.81 | 2.08 | 9.6 | 1.39 | 0.08 | none | good | none |
| 5 | 1.50 | 1.78 | 26.4 | 1.32 | 0.08 | none | good | none |
| 6 | 1.15 | 1.60 | 5.6 | 1.28 | 0.08 | none | good | none |
| 7 | 1.80 | 5.00 | 48.0 | 1.41 | 0.05 | none | good | none |
| Comparison | | | | | | | | |
| 8 | 1.05 | 1.33 | 4.5 | 1.35 | 0.12 | severe | poor | none |
| 9 | 1.05 | 1.33 | 50.8 | 1.30 | 0.11 | severe | poor | none |
| 10 | 2.36 | 6.11 | 30.8 | 1.28 | 0.12 | severe | poor | none |
| 11 | 2.86 | 2.97 | 21.2 | 1.39 | 0.11 | some | blurred | severe |

Since the difference of Qt−Qc of No. 8 (4.5 μC/g) and No. 9 (50.8 μC/g) were outside the range specified in the present invention, the background fogging and toner spreading occurred and the resolution was poor. Although No. 11 showed somewhat good results in the toner spreading and resolution as compared with Nos. 8 and 9, the background fogging and carrier adhesion were severe due to the extremely low specific volume resistance. No. 10 produced images of a poor quality with respect to the background fogging, toner spreading and resolution due to the extremely high particle size ratio of Dc/Dt.

Nos. 1 to 7 satisfying the requirements of the present invention produced images of a high image density and a high quality with no background fogging, toner spreading and carrier adhesion in the wide range of toner concentration.

EXAMPLE 2

By using the magnetic toners Nos. 12 to 15 and the corresponding magnetic carriers Nos. 12 to 15, the developing test was conducted under the following developing conditions.

Reversal development

Photosensitive surface: positively chargeable α-Si

+400 V of surface voltage 50 mm/sec of peripheral speed (clockwise)

Sleeve: stainless (SUS304)

20 mm of outer diameter 100 mm/sec of peripheral speed (counter-clockwise)

Permanent magnet: unsymmetrical 4 poles (stationary)

surface magnetic flux density: 700 G for developing pole and 600 G for other poles Developing gap (Ds): 0.4 mm Doctor gap (Dg): 0.3 mm Bias to sleeve: +350 V DC Transfer: corona transfer to ordinary paper Fixing: heat roll fixing at 180° C. under line pressure of 1 kgf/cm The results are shown in Table 4.

TABLE 4

| Test No. | Magnetic Toner $\sigma_{1000t}$ (emu/g) | Dt (μm) | Qt (μC/g) | Magnetic Carrier Rc (Ω · cm) | $\sigma_{1000c}$ (emu/g) | Dc (μm) | Qc (μC/g) | Toner Concentration (wt. %) |
|---|---|---|---|---|---|---|---|---|
| Invention | | | | | | | | |
| 12 | 18 | 9.0 | 20.3 | $10^{14}$ | 25 | 18 | −3.5 | 10 |
| 13 | 22 | 12.0 | 11.2 | $10^{14}$ | 33 | 10 | −27.5 | 30 |
| 14 | 22 | 7.5 | 30.3 | $10^{14}$ | 33 | 12 | 23.1 | 50 |
| Comparison | | | | | | | | |
| 15 | 21 | 9.0 | 8.5 | $10^{14}$ | 32 | 16 | 5.5 | 50 |

| Test No. | $\sigma_{1000c}/\sigma_{1000t}$ | Dc/Dt | Qt-Qc (μC/g) | Image Quality: image density | Background fogging | toner spreading | resolution | carrier adhesion |
|---|---|---|---|---|---|---|---|---|
| Invention | | | | | | | | |
| 12 | 1.39 | 2.00 | 23.8 | 1.25 | 0.07 | none | good | none |
| 13 | 1.50 | 0.83 | 38.7 | 1.31 | 0.08 | none | good | none |
| 14 | 1.50 | 1.60 | 7.2 | 1.35 | 0.08 | none | good | none |
| Comparison | | | | | | | | |
| 15 | 1.50 | 1.80 | 3.0 | 1.28 | 0.09 | severe | poor | none |

Since the difference (Qt−Qc) of No. 15 was smaller than the range specified in the present invention, the background fogging and toner spreading occurred and the resolution was poor.

Nos. 12 to 14 satisfying the requirements of the present invention produced, in the wide range of toner concentration, images of a high image density and a high quality with no background fogging, toner spreading and carrier adhesion.

EXAMPLE 3

By using the magnetic toners Nos. 16 to 19 and the corresponding magnetic carriers Nos. 16 to 19, the developing test was conducted under the following developing conditions.

Reversal development

Photosensitive surface: negatively chargeable OPC
−600 V of surface voltage
50 mm/sec of peripheral speed (clockwise)

Permanent magnet: sleeve-less ferrite magnet (YBM-3 manufactured by Hitachi Metals, Ltd.)
symmetrical 32 poles
400 G of surface magnetic flux density
150 mm/sec of peripheral speed (counter-clockwise)

Developing gap (Ds): 0.4 mm

Doctor gap (Dg): 0.35 mm

Bias: DC −500V superposed with AC of Vp−p=800V and f=1.0 kHz through doctor blade Transfer: corona transfer to ordinary paper Fixing: heat roll fixing at 180° C. under line pressure of 1 kgf/cm The results are shown in Table 5.

TABLE 5

| Test No. | Magnetic Toner $\sigma_{1000t}$ (emu/g) | Dt (μm) | Qt (μC/g) | Magnetic Carrier Rc (Ω · cm) | $\sigma_{1000c}$ (emu/g) | Dc (μm) | Qc (μC/g) | Toner Concentration (wt. %) |
|---|---|---|---|---|---|---|---|---|
| Invention | | | | | | | | |
| 16 | 22 | 7.0 | −57.2 | $10^{10}$ | 63 | 23 | −12.5 | 40 |
| 17 | 22 | 9.5 | −37.3 | $10^{12}$ | 52 | 30 | 7.3 | 40 |
| 18 | 22 | 11.1 | −15.1 | $10^{14}$ | 33 | 15 | +2.5 | 40 |
| Comparison | | | | | | | | |
| 19 | 22 | 11.1 | −15.1 | $10^{14}$ | 27 | 23 | −12.0 | 40 |

| Test No. | $\sigma_{1000c}/\sigma_{1000t}$ | Dc/Dt | Qt-Qc (μC/g) | Image Quality: image density | Background fogging | toner spreading | resolution | carrier adhesion |
|---|---|---|---|---|---|---|---|---|
| Invention | | | | | | | | |
| 16 | 2.86 | 3.29 | −44.7 | 1.28 | 0.07 | none | good | none |

TABLE 5-continued

| | | | | | | | | |
|---|---|---|---|---|---|---|---|---|
| 17 | 2.36 | 3.16 | −30.0 | 1.39 | 0.07 | none | good | none |
| 18 | 1.50 | 1.35 | −17.6 | 1.25 | 0.07 | none | good | none |
| Comparison | | | | | | | | |
| 19 | 1.23 | 2.07 | −3.1 | 1.00 | 0.13 | severe | poor | none |

Since the difference (Qt−Qc) of No. 19 was smaller than the range specified in the present invention, the image density was low, background fogging and toner spreading occurred and the resolution was poor.

Nos. 16 to 18 satisfying the requirements of the present invention produced images of a high image density and a high quality no background fogging, toner spreading and carrier adhesion.

As described above, when the magnetic toner and the magnetic carrier satisfy the requirements of the present invention with respect to the particle size ratio, the magnetization ratio and the difference in the triboelectric charge, images of a high quality with no background fogging, toner spreading and carrier adhesion are obtained in a wide range of toner concentration without using a means for controlling the toner concentration.

What is claimed is:

1. A developer for electrostatic development, which is a mechanical mixture of a magnetic toner containing a binder resin and a magnetic powder as the essential components of the toner and a magnetic carrier having a specific volume resistance of $10^9 \Omega\cdot$ cm or more, an average particle size of said magnetic carrier being 0.5 to 6 times an average particle size of said magnetic toner, a magnetization of said magnetic carrier being 0.5 to 4 times a magnetization of said magnetic toner, and a triboelectric charge of said magnetic carrier (Qc) and a triboelectric charge of said magnetic toner (Qt) satisfying an equation: $|Qt-Qc|=5$ to 50 $\mu$ C/g , wherein said magnetic toner has a volume average particle size of 7 to 15 $\mu$m.

2. The developer according to claim 1, wherein said magnetic toner contains said magnetic powder in an amount of 20 to 60% by weight based on the total weight of said magnetic toner.

3. The developer according to claim 1, wherein said magnetic toner has a magnetization of 11 to 40 emu/g.

4. The developer according to claim 1, wherein said magnetic toner has a triboelectric charge of 10 $\mu$C/g or more.

5. The developer according to claim 1, wherein a concentration of said magnetic toner in said developer is 5 to 70% by weight based on the total weight of said developer.

6. A method of developing an electrostatic latent image, comprising:

electrostatically charging a surface of a rotating hollow cylindrical photosensitive drum to a uniform potential;

exposing the electrostatically charged surface of said photosensitive drum to a light image of original informational data being reproduced to form an electrostatic latent image corresponding to said original informational data;

transporting a developer comprising a magnetic carrier and a magnetic toner to a developing zone defined by a gap between said photosensitive drum and a non-magnetic, hollow cylindrical sleeve concentrically and rotatably containing inside thereof a permanent magnet roll having a plurality of magnetic poles on the surface thereof, said developer being attracted on the surface of said sleeve and transported to said developing zone by a relative rotation of said sleeve to said permanent magnet roll; and developing said latent image by bringing a magnetic brush of said developer into contact therewith in said developing zone to form a toner image on said image-bearing member;

a specific volume resistance of said magnetic carrier being $10^9 \Omega\cdot$cm or more, an average particle size of said magnetic carrier being 0.5 to 6 times an average particle size of said magnetic toner, a magnetization of said magnetic carrier being 0.5 to 4 times a magnetization of said magnetic toner, and a triboelectric charge of said magnetic carrier (Qc) and a triboelectric charge of said magnetic toner (Qt) satisfying an equation: $|Qt-Qc|=5$ to 50 $\mu$C/g, wherein said magnetic toner has a volume average particle size of 7 to 15 $\mu$m.

7. A method of developing an electrostatic latent image, comprising:

electrostatically charging a surface of a rotating hollow cylindrical photosensitive drum to a uniform potential;

exposing the electrostatically charged surface of said photosensitive drum to a light image of original informational data being reproduced to form an electrostatic latent image corresponding to said original informational data;

transporting a developer comprising a magnetic carrier and a magnetic toner to a developing zone defined by a gap between said photosensitive drum and a rotatable cylindrical permanent magnet roll having a plurality of magnetic poles on the surface thereof, said developer being attracted on the surface of said magnet roll and transported to said developing zone by a rotation of said magnet roll; and developing said latent image by bringing a magnetic brush of said developer into contact therewith in said developing zone to form a toner image on said image-bearing member;

a specific volume resistance of said magnetic carrier being $10^9 \Omega\cdot$cm or more, an average particle size of said magnetic carrier being 0.5 to 6 times an average particle size of said magnetic toner, a magnetization of said magnetic carrier being 0.5 to 4 times a magnetization of said magnetic toner, and a triboelectric charge of said magnetic carrier (Qc) and a triboelectric charge of said magnetic toner (Qt) satisfying an equation: $|Qt-Qc|=5$ to 50 $\mu$C/g. wherein said magnetic toner has a volume average particle size of 7 to 15 $\mu$m.

8. The developer according to claim 6, wherein said magnetic toner contains a magnetic powder in an amount of 20 to 60% by weight based on the total weight of said magnetic toner.

9. The developer according to claim 6, wherein said magnetic toner has a magnetization of 11 to 40 emu/g.

10. The developer according to claim 6, wherein said magnetic toner has a triboelectric charge of 10 $\mu$C/g or more.

11. The developer according to claim 6, wherein a concentration of said magnetic toner in said developer is 5 to 70% by weight based on the total weight of said developer.

12. The developer according to claim 7, wherein said magnetic toner contains a magnetic powder in an amount of 20 to 60% by weight based on the total weight of said magnetic toner.

13. The developer according to claim 7, wherein said magnetic toner has a magnetization of 11 to 40 emu/g.

14. The developer according to claim 7, wherein said magnetic toner has a triboelectric charge of 10 $\mu$C/g or more.

15. The developer according to claim 7, wherein a concentration of said magnetic toner in said developer is 5 to 70% by weight based on the total weight of said developer.

* * * * *

UNITED STATES PATENT AND TRADEMARK OFFICE

CERTIFICATE OF CORRECTION

PATENT NO. : 5,866,289

DATED : February 2, 1999

INVENTOR(S) : Masumi ASANAE et al.

It is certified that error appears in the above-identified patent and that said Letters Patent is hereby corrected as shown below:

Column 13, line 38, change "μ C/g" to --μC/g--.

Column 14, line 60, change "μC/g." to --μC/g,--.

Signed and Sealed this

Third Day of August, 1999

*Attest:*

Q. TODD DICKINSON

*Attesting Officer*

*Acting Commissioner of Patents and Trademarks*